US008414943B2

(12) United States Patent
Wijngaarden et al.

(10) Patent No.: US 8,414,943 B2
(45) Date of Patent: Apr. 9, 2013

(54) PROCESS FOR PRODUCING A PALM OIL PRODUCT

(75) Inventors: Leendert Wijngaarden, Bongerdstraat (NL); Ninke Margreet Hiemstra, Heemstede (NL)

(73) Assignee: Loders Croklaan B.V., Wormerveer (NL)

( * ) Notice: Subject to any disclaimer, the term of this patent is extended or adjusted under 35 U.S.C. 154(b) by 0 days.

(21) Appl. No.: 12/809,014

(22) PCT Filed: Dec. 18, 2008

(86) PCT No.: PCT/EP2008/010837

§ 371 (c)(1),
(2), (4) Date: Oct. 5, 2010

(87) PCT Pub. No.: WO2009/080288

PCT Pub. Date: Jul. 2, 2009

(65) Prior Publication Data

US 2011/0052781 A1 Mar. 3, 2011

(30) Foreign Application Priority Data

Dec. 21, 2007 (EP) ..... 07255005

(51) Int. Cl.
*C11B 7/00* (2006.01)

(52) U.S. Cl.
USPC ..... 426/417; 426/478; 426/601

(58) Field of Classification Search ..... 426/601, 426/417, 478
See application file for complete search history.

(56) References Cited

U.S. PATENT DOCUMENTS

| | | | |
|---|---|---|---|
| 2,898,211 | A | 8/1959 | Barsky et al. |
| 2,975,060 | A | 3/1961 | Best et al. |
| 3,012,897 | A | 12/1961 | Sullivan et al. |
| 3,632,616 | A | 1/1972 | Kassabian |
| 3,686,240 | A | 8/1972 | Kawada et al. |
| 4,104,290 | A | 8/1978 | Koslowsky |
| 4,243,603 | A | 1/1981 | Klein et al. |
| 4,343,744 | A | 8/1982 | Kawai et al. |
| 4,588,604 | A | 5/1986 | Baker et al. |
| 5,210,241 | A | 5/1993 | Lin |

(Continued)

FOREIGN PATENT DOCUMENTS

| | | |
|---|---|---|
| DE | 27 47 765 | 4/1979 |
| DE | 27 47 765 A1 | 4/1979 |

(Continued)

OTHER PUBLICATIONS

Jeyarani, T. 2003. JAOCS 80(11)1107.*

(Continued)

*Primary Examiner* — Carolyn Paden
(74) *Attorney, Agent, or Firm* — Hamilton, Brook, Smith & Reynolds, P.C.

(57) ABSTRACT

A process for producing a palm oil product comprises: (i) partial crystallization of a palm oil or fraction thereof in the absence of a solvent; (ii) mixing the partially crystallized palm oil or fraction with a solvent; (iii) crystallizing the resulting mixture to a greater extent; and (iv) separating the resulting solid from the liquid in a separator, wherein the partially crystallized palm oil or fraction thereof that is formed in (i) is directly mixed with solvent in (ii) without separation of solids from liquids prior to (ii).

17 Claims, 2 Drawing Sheets

U.S. PATENT DOCUMENTS

| | | | |
|---|---|---|---|
| 6,265,595 | B1 | 7/2001 | Taniguchi et al. |
| 2002/0156306 | A1 | 10/2002 | Foglia et al. |
| 2007/0160739 | A1 | 7/2007 | Kuwabara et al. |

FOREIGN PATENT DOCUMENTS

| | | | |
|---|---|---|---|
| EP | 0 084 900 | B1 | 4/1986 |
| EP | 0 081 881 | B1 | 4/1987 |
| EP | 0 457 401 | A1 | 11/1991 |
| EP | 0 744 899 | B1 | 10/1998 |
| EP | 1 120 455 | A1 | 8/2001 |
| GB | 827172 | | 2/1960 |
| GB | 859769 | | 1/1961 |
| GB | 861016 | | 2/1961 |
| GB | 893337 | | 4/1962 |
| GB | 953452 | | 3/1964 |
| GB | 1 349 846 | | 4/1974 |
| GB | 1 455 581 | | 11/1976 |
| GB | 1 499 333 | | 2/1978 |
| GB | 1 510 082 | | 5/1978 |
| GB | 2 013 705 | A | 8/1979 |
| GB | 2 023 636 | A | 1/1980 |

OTHER PUBLICATIONS

Notification of Transmittal of the International Search Report and the Written Opinion of the International Searching Authority, or the Declaration, International Application No. PCT/EP2008/010837, Date of Mailing: Apr. 1, 2009.

Smith, K.W., et al., "Liquid-liquid phase separation in acetone solutions of palm olein: Implications for solvent fractionation," *Eur. J. Lipid Sci. Technol.*, 109: 350-358 (2007).

Notification Concerning Transmittal of International Preliminary Report on Patentability (Chapter I of the Patent Cooperation Treaty) and the Written Opinion, International Application No. PCT/EP2008/010837, mailed Jul. 1, 2010 (8 pages).

Extended European Search Report from European Application No. 07255005.6; Dated: Jun. 13, 2008, 3 pgs.

The Horizontal Belt Filter [online], [retrieved on Nov. 22, 2007]. Retrieved from the Internet URL:http://www.solidliquid-separation.com/VacuumFilters/Belt/belt.htm, 5 pgs, Anon.

Hashimoto, S., et al., "Preparation of Sharp-Melting Hard Palm Midfraction and its Use as Hard Butter in Chocolate," *Journal of the American Oil Chemists' Society* [online], 2001, [retrieved on Aug. 17, 2010]. Retrieved from the Internet URL:http://cat.inist.fr/?aModele=afficheN&cpsidt=1043060, Abstract Only.

Ibrahim, N. H., et al., "Polymorphism of Anhydrous Milk Fat as Affected by the Addition of Palm Stearins," *Journal of Oil Palm Research* [online], Apr. 2006 [retrieved on Aug. 23, 2010]. Retrieved from the Internet URL: http://webcache.googleusercontent.com/search?q=cache:N95Xu799y-cJ:palmoils.mpob.gov.my/publications/jopr2006sp-ms58.pdf+palm+fractionation+%22oil+t0+solvent%22&hl=nl&ct=clnk&cd=5&gl=nl, 7 pgs.

Harris, J., "Why Solvent Fractionation?," SCI Fractionation Conference [online], Nov. 22-23, 2005. Retrieved from the Internet URL: http://www.soci.org/SCI/groups/oil/2006/reports/pdf/Harris.pdf, 20 pgs.

Soon, W., "Specialty Fats Versus Cocoa Butter," Atlanto Sdn. Bhd., Malaysia, p. 232 (1991).

Timms, R., "The History and Current Status of Fractionation," [online], 2006. Retrieved from the Internet URL:http://www.soci.org/SCI/groups/oil/2006/reports/pdf/Timms_LP.pdf, 8 pgs.

Hamm, W., "Fractionation—With or Without Solvent?," Fette, Seifen, Anstrichmittel, 99(S1):533-537 (1986) [online] [retrieved on Aug. 17, 2010]. Retrieved from URL: http://onlinelibrary.wiley.com/doi/10.1002/lipi.19860881310/abstract, Abstract Only.

Zelaya de la Parra, E., "Optimization of a Process for the Solvent Fractionation of Palm Oil Using a Model Based on Interpolation of Experimental Data," *Chemical Engineering & Technology* 23(2):165-170 (2000) [online] [retrieved on Aug. 17, 2010]. Retrieved from the Internet URL: http://onlinelibrary.wiley.com/doi/10.1002/(SICI)1521-4125(200002)23:2%3C165::AID-CEAT165%3E3.0.CO;2-G/abstract, Abstract Only.

* cited by examiner

PROCESS FOR PRODUCING A PALM OIL PRODUCT

This application is the U.S. National Stage of International Application No. PCT/EP2008/010837, filed Dec. 18, 2008, which designates the U.S., published in English, and claims priority under 35 U.S.C. §§119 or 365(c) to European Application No. 07255005.6, filed Dec. 21, 2007.

BACKGROUND OF THE INVENTION

This invention relates to a process for producing a palm oil product and to the palm oil product obtainable by the process.

Palm oil is produced on a large scale for use in a number of different applications, including in food. Palm oil is typically obtained from the flesh of the palm fruit (*Elaeis guineensis*). A palm tree normally produces approximately one fruit bunch, containing as many as 3,000 fruitlets, each month. Each palm tree normally continues producing fruit economically for up to 25 years. This ensures a good supply of palm oil.

Palm oil is usually processed in order to obtain products having specific properties. For example, palm oil may be fractionated to separate the higher melting components, usually referred to as palm stearin, from the lower melting components, usually referred to as palm olein. The composition of the fractions depends on the conditions under which fractionation is carried out.

Fractionation of palm oil is generally carried out by one of three methods i.e., dry fractionation, solvent fractionation and fractionation in the presence of a detergent. In dry fractionation, the stearin is crystallized from the oil in the absence of a solvent using temperature to control the formation of solids as crystals. Solvent fractionation involves the addition of solvents such as acetone to effect the separation of the stearin from the olein.

Fractionation of fats and oils has been reviewed by, for example, Timms in http://www.soci.org/SCI/groups/oil/2006/reports/pdf/Timms_LP.pdf.

GB 1455581 discloses a fat blend. One of the fats that is used in the blend is a palm-based fat obtained by wet fractionation of fat using acetone.

GB 1499333 describes olein-stearin separation of vegetable, animal and fish oils using mixtures of solvents which contain water or a polyhydroxy compound and a polar organic solvent.

GB-A-2023636 relates to a process for producing four edible fractions from a natural fatty substance by solvent fractionation followed by esterification of the resulting fluid fraction and further fractionation.

US 2007/0160739 describes a method of dry fractionation of fats and oils which involves obtaining a first fraction and mixing it with a liquid fat or oil to effect a further fractionation.

Wong Soon, Speciality Fats Versus Cocoa Butter, 1991, page 232 shows a generalized scheme for the fractionation of palm oil which employs a ratio of solvent to oil of 4:1.

DE-A-2747765 discloses a fat with a high content of 1,3-dipalmitoyl-2-oleoyl glycerol, a process for its production and its use.

EP-A-1120455 relates to a fractionated palm oil and a process for its production.

There remains a need for improved fractionation processes. In particular, there is a desire to use less organic solvent in wet fractionation, and to use solvents in which the amount of water is less critical and so need not be completely dried (thereby reducing overall costs), whilst still producing a good product in a relatively high yield.

SUMMARY OF THE INVENTION

According to the present invention, there is provided a process for producing a palm oil product, which comprises: (i) partial crystallization of palm oil or a fraction thereof in the absence of a solvent; (ii) mixing the partially crystallized palm oil or fraction with a solvent; (iii) crystallizing the resulting mixture to a greater extent; and (iv) separating the resulting solid from the liquid in a separator.

In another aspect, the invention provides a palm oil product, preferably a palm oil mid-fraction, that is obtained or is obtainable by the process of the invention.

It has been found that it is possible to produce a palm oil product, which is a palm oil fraction, such as a palm oil mid-fraction, having good properties in terms of relatively high POP content and relatively low PPP content, using a relatively low amount of solvent and a solvent in which the moisture content does not have to be carefully controlled to a relatively low level. This means that the process can use solvents and process lines that are suitable for the fractionation of other non-palm fats and oils (i.e., fats and oils that do not originate from palm), such as shea oil. The process can therefore be run in parallel with the processing of other non-palm fats and oils.

DETAILED DESCRIPTION OF THE INVENTION

Figure 1:
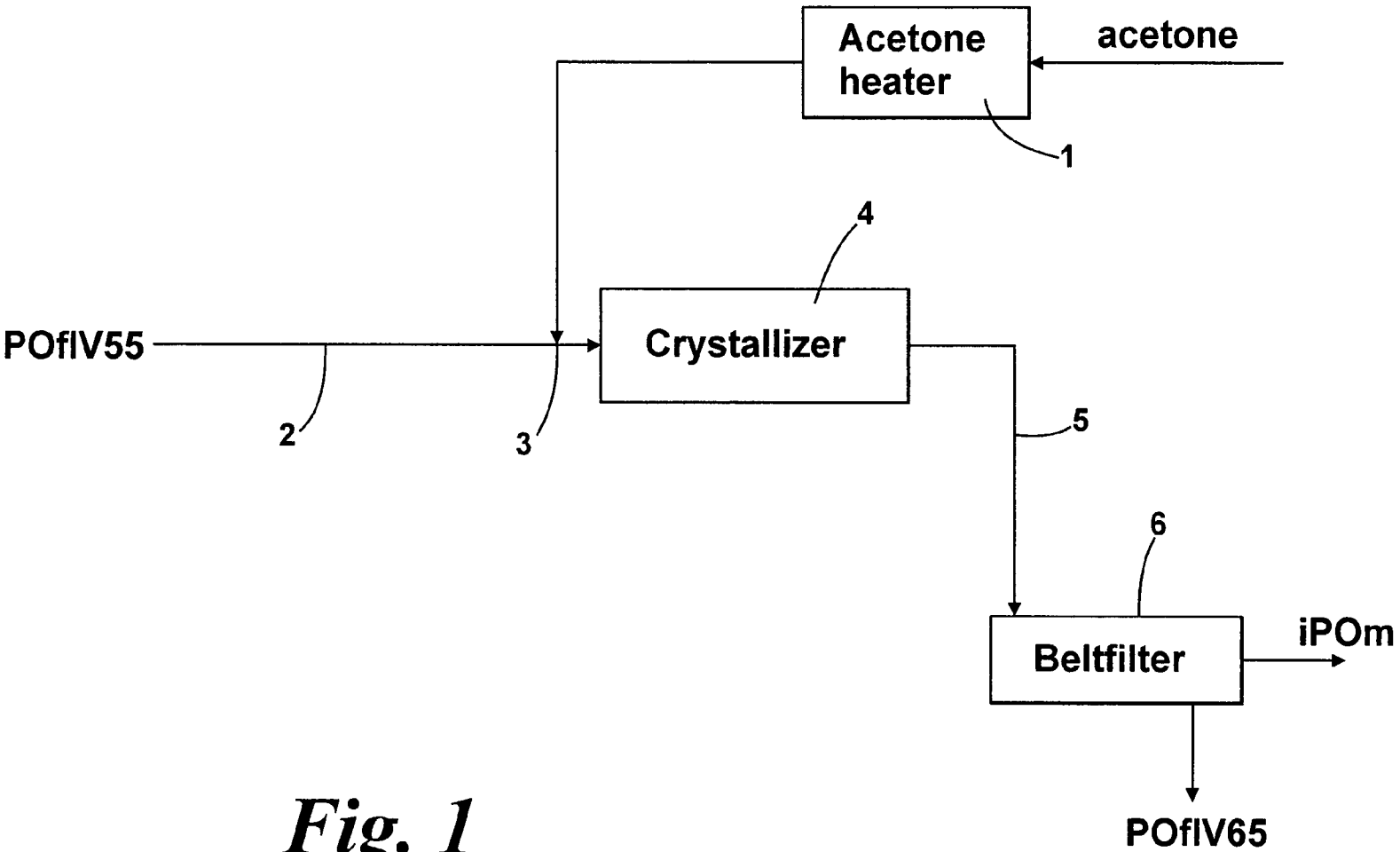
FIG. 1 shows the solvent fraction of palm olein.

The invention uses a combination of dry and wet fractionation with a first dry fractionation step that involves incomplete (or partial) crystallization.

The starting material for the process of the invention is palm oil or a fraction thereof. Preferably, the starting material is palm oil olein; more preferably, this palm oil olein is produced by dry fractionation. Preferably, the palm oil olein has an iodine value (IV) of between 35 and 65, more preferably from 50 to 60.

The process of the invention comprises a first step (i) of partially crystallizing the palm oil or a fraction thereof, such as a palm oil olein. The terms "partial crystallization" and "partially crystallizing" and related terms, as used herein, preferably mean that at the relevant stage in the process (i.e., immediately after (i)) not all of the solid that is obtained at the end of the process (e.g., after separation in (iv)) is crystallized i.e., the weight of the crystallized solid that is obtained is less than that obtained at the end of the process. It has been found that this partial crystallization of the palm oil olein before wet fractionation allows the process to be operated using low amounts of solvent that need not be very dry.

It will be appreciated that the terms "crystallized solid" and related terms used herein refer to the solid obtained in general terms and do not mean that the solid is fully crystalline. For example, the solid may contain some material that is crystalline and some that is not crystalline. Typically, the solid will contain a mixture of compounds.

Preferably, the partially crystallized palm oil or fraction of palm oil that is formed in (i) comprises from 5 to 25% crystalline solids, more preferably from 10 to 24% crystalline solids, such as from 15 to 22%, or from 17 to 21%, crystalline solids. It will be understood that the percentage of the crystalline solids obtained at this stage of the process can be determined by, for example, standard NMR techniques (e.g., according to ISO 8292) for analyzing the solid content of fats (SFC). In contrast, the amount of solids that is separated in (iv) is generally from more than 22% up to 35% by weight based on the weight of the palm oil or fraction thereof that is used as the starting material for the process, more preferably from 23 to 30% by weight, such as from 23.5 to 29% by weight or from 24 to 28% by weight.

Step (i) may be carried out in a single step or in two or more steps. Preferably, step (i) is a two-stage process carried out in two separate tanks, each of which involves a step of dry fractionation. Step (i) is preferably carried out at a temperature in the range of from 12 to 20° C. If step (i) is a two stage process, the second dry fractionation step is preferably carried out at a lower temperature than the first dry fractionation step. For example, the first step is preferably carried out at a temperature in the range of from 15 to 20° C. and the second step is carried out at a temperature of from 13 to 17° C.

Optionally, a lower melting palm fraction (such as a palm oil olein having an iodine value (IV) of from 60 to 70 e.g., POfIV65) may be mixed with the palm oil or fraction thereof used as the starting material for the process before or during (i), preferably in an amount of up to 10% by weight of the starting material palm oil or fraction thereof.

The partially crystallized palm oil or fraction thereof that is formed in (i) is not separated to remove the solids from the liquid but is mixed with a solvent in (ii). Thus, the mixture of solids and liquids that is formed in (i) is preferably directly mixed with solvent in (ii) without separation of the solids from the liquids prior to (ii). The partially crystallized palm oil or fraction thereof that is formed in (i) is a mixture of solids and liquid and typically takes the form of a slurry.

Preferably, the temperature of the partially crystallized palm oil or fraction thereof immediately prior to mixing with the solvent in (ii) is from 10 to 25° C., more preferably from 12 to 22° C., even more preferably from 15 to 20° C., such as about 17 to 18° C. The temperature of the solvent immediately prior to mixing with the partially crystallized palm oil or fraction thereof in (ii) is preferably lower than the temperature of the partially crystallized palm oil or fraction thereof and is preferably less than 18° C., more preferably from 5° C. to 17° C., even more preferably from 10° C. to 15° C. Preferably, the temperature of the partially crystallized palm oil or fraction thereof immediately prior to mixing with the solvent in (ii) is from 10 to 25° C., more preferably from 12 to 22° C., even more preferably from 15 to 20° C., such as about 17 to 18° C., and the temperature of the solvent immediately prior to mixing with the partially crystallized palm oil or fraction thereof in (ii) is less than 18° C., more preferably from 5° C. to 17° C., even more preferably from 10° C. to 15° C., with the optional further preferred feature that the temperature of the solvent immediately prior to mixing with the partially crystallized palm oil or fraction thereof in (ii) is preferably lower than the temperature of the partially crystallized palm oil or fraction thereof.

Immediately after mixing in (ii), the temperature of the mixture is preferably from 8 to 20° C., more preferably from 9 to 18° C., even more preferably from 10 to 16° C.

The weight ratio of solvent to palm oil or fraction thereof in (ii) is preferably in the range of from 1.5:1 to 1:1.5, more preferably from 1.4:1 to 1:1.4, even more preferably from 1.3:1 to 1:1.3, such as from 1.2:1 to 1:1.2. For example, the weight ratio of solvent to palm oil or fraction thereof is usually from 0.8:1 to 1.5:1, such as from 0.8:1 to 1.1:1, or about 1:1.

The mixing of the partially crystallized palm oil or fraction thereof with the solvent in (ii) is preferably carried out in-line. For example, the partially crystallized palm oil or fraction thereof may be pumped out of a tank in which step (i) is performed and mixed with the solvent in the conduit (such as a pipe) through which it is then passed.

The solvent preferably comprises acetone and water, the water being present in an amount of at least 0.3% by weight of the solvent, such as at least 0.4%, at least 0.5% or at least 0.6% by weight. The amount of water in the solvent will usually be less than 2%, such as less than 1.5%, less than 1.2% or less than 1%. Therefore, the solvent typically comprises from 0.3% to 1.5% by weight water, more preferably from 0.4% to 1.2% by weight water, such as from 0.6% to 1.0% by weight water. The solvent preferably comprises at least 90% by weight acetone, such as at least 95%, at least 97%, at least 98%, or at least 99% by weight acetone. A preferred solvent comprises from 0.6% to 1.2% by weight water and at least 98.5% by weight acetone.

After mixing with the solvent, the resulting mixture is crystallized in (iii) to a greater extent than in (i). Preferably, the crystallization in (iii) is carried out with cooling. During (iii), the mixture is preferably cooled by at least 2° C. For example, the mixture may be cooled by from 2° C. to 10° C. After passage through the crystallizer, the mixture preferably has a temperature of from 5° C. to 10° C. Typically, crystallization is carried out at a lower temperature than in (i), for example at least 3° C. lower or at least 5° C. lower than in (i). Preferably, (iii) is carried out in a crystallizer, more preferably in a scraped surface crystallizer that allows continuous passage of the mixture; this allows the process of the invention to be operated on a continuous basis in (iii). Scraped surface crystallizers comprise rotors that remove cooled solids from the wall of the crystallizer and are well known in the art.

Typically, (ii) and (iii) are carried out in separate vessels. For example, the mixing in (ii) preferably takes place in a conduit (such as a pipe) in line, whereas (iii) preferably takes place in a separate crystallizer.

After the mixture has been crystallized in (iii) to a greater extent than in (i) (i.e., such that the amount of crystalline solids in the mixture, based on the weight of palm oil or fraction thereof used as the starting material, is greater in (iii) than in (i)), the resulting solid is separated from the liquid in a separator in (iv). Preferably, the mixture is pumped directly to the separator. A preferred separator is a belt filter. The solids (also sometimes referred to as the stearin fraction) are retained on the belt of the filter while the liquids pass through it. Suitable apparatus, such as a belt filter, for effecting the separation of the solids from the liquid is well known in the art.

The process of the invention may comprise one or more steps before, between or after steps (i) to (iv). For example, the product obtained in (iv) may be further purified by removal of the solvent.

The solvent is preferably recovered from the liquids that remain after the solid has been separated and is recycled back into the process. Solvent is preferably recovered from the solids after separation and recycled. More preferably, solvent is recovered from the liquids and the solids and is recycled.

The process of the invention may be carried out batchwise or operated on a continuous basis. Preferably, the process is continuous. The input of starting material palm oil or fraction thereof is preferably from 0.5 to 100 tonnes per hour (t/h).

The palm oil product (or fraction) that is obtained as the solid after separation is preferably a palm oil mid-fraction. The palm oil product preferably has the following triglyceride content:

PPP from 2.5 to 4.0% by weight;
POP greater than 65% by weight; and
POO less than 3% by weight.

(P=palmitic acid and O=oleic acid)

The palm oil product may contain trace amounts of the solvent (acetone) and water and is substantially free, or free of detergent.

The liquid (olein) fraction that is obtained after removal of the solvent is also a useful product. The preferred palm oil olein that is produced in the process of the invention as the liquid after separation in (iv), and after removal of solvent, has an iodine value (IV) of from 60 to 70, such as about 65.

The process of the invention may be run in parallel with the fractionation of shea oil. The present invention allows the two fractionation processes to operate using the same solvent. This is a significant advantage.

The palm oil products that are produced in the process may be used in a variety of applications, such as in foodstuffs and in processes for producing other fats and oils, for example by interesterification.

The listing or discussion of an apparently prior-published document in this specification should not necessarily be taken as an acknowledgement that the document is part of the state of the art or is common general knowledge.

The following non-limiting examples illustrate the invention and do not limit its scope in any way. In the examples and throughout this specification, all percentages, parts and ratios are by weight unless indicated otherwise.

EXAMPLES

The process that may be used in the invention is depicted schematically in FIG. 1.

Acetone is passed to acetone heater 1 where its temperature is adjusted upwards or downwards, as appropriate. POfIV55 (palm olein with an iodine value of 55) is pumped along line 2 and is mixed with colder acetone in-line at 3.

The resulting acetone/POfIV55 mixture is pumped directly to scraped surface crystallizer 4 where its temperature is reduced. The cooled mixture is pumped via line 5 to belt filter 6 where the solids (iPOm) are separated from the liquids (POfIV65 plus solvent).

Figure 2:
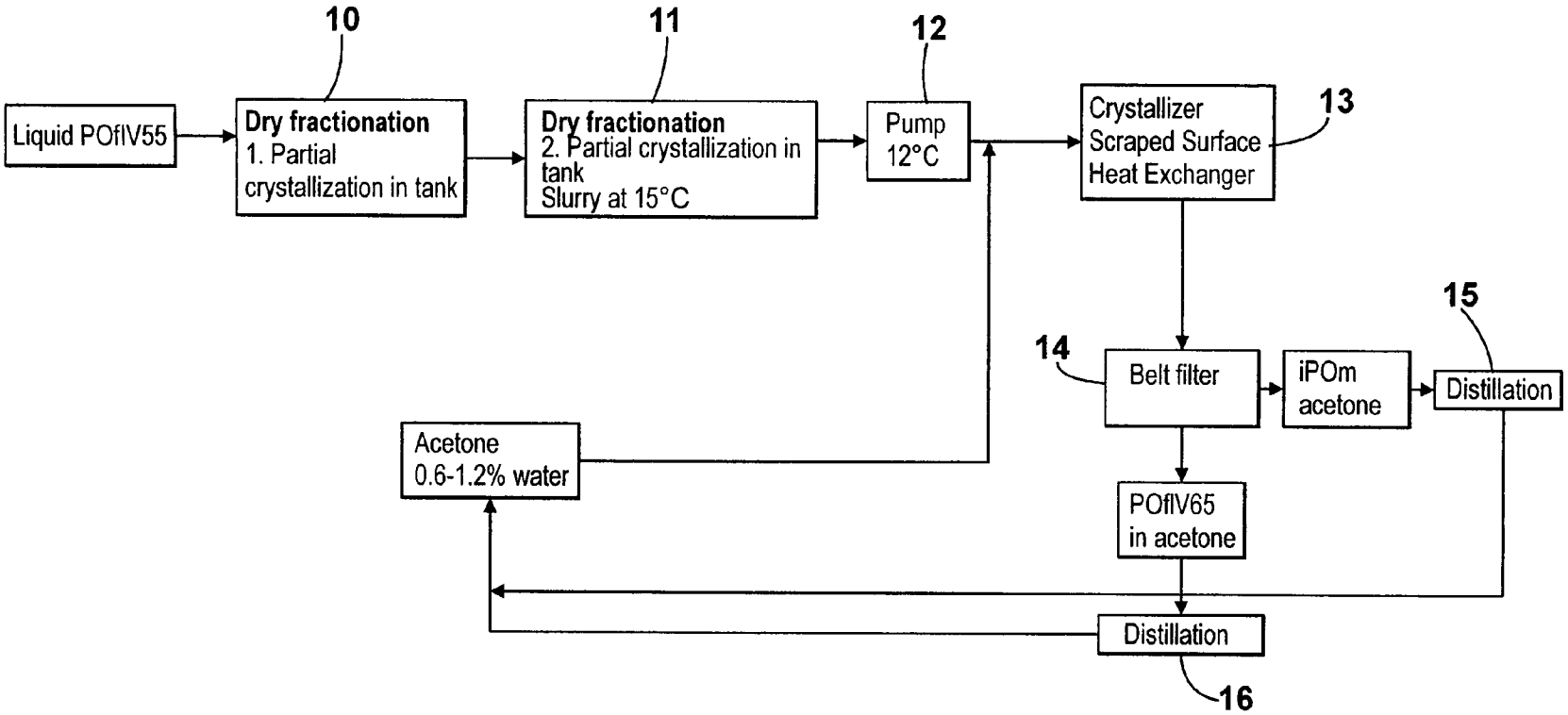
FIG. 2 shows two dry fractionation steps and the recycling of acetone in the fraction of palm olein.

A further embodiment of the process of the invention is shown in FIG. 2.

The process shown in FIG. 2 comprises two dry fractionation steps in (i) and shows the recycling of the acetone solvent.

In FIG. 2, POfIV55 is subjected to two sequential dry fractionation steps in first and second separate tanks 10, 11 to effect partial crystallization of the solids. After these two steps, the resulting mixture of solids and liquids, in the form of a slurry, has a temperature of 15° C. The slurry is pumped out of the second tank and is mixed in-line at mixing point 12 with acetone containing 0.6-1.2% by weight water. The resulting mixture has a temperature of 12° C. The mixture is then passed to scraped surface crystallizer 13 where crystallization takes place to a greater extent and is completed. The resulting mixture is passed to belt filter 14 where the solids (iPOm) are separated from the liquids (POfIV65). Both the solids and the liquids comprise acetone and this is separated by distillation at distillation steps 15 and 16 and recycled back into the process.

Example 1

POfIV55 was obtained by dry fractionation. The POfIV55 was partially crystallized in a dry fractionation crystallizer such that the mixture contained 18-19% by weight solids (as crystals). Up to 10% by weight POfIV65 was mixed with POfIV55 in the dry fractionation crystallizer.

The mixture obtained from the crystallizer was pumped in-line and mixed with cold acetone to give a temperature of the resulting mixture of 12° C. The acetone contained 0.4% water and the weight ratio of acetone (including its water) to mixture was 1:1. The POfIV55/acetone mixture was pumped to a scraped surface crystallizer where it was cooled to 9° C. The time taken for passage through the crystallizer was 13 minutes. The resulting cooled mixture was pumped to a belt filter.

POfIV55 input was 1.6 t/h throughout the whole trial.

The results are shown in Table 1.

The results of this trial are good: Moisture in acetone has much less influence on the quality than with the standard processes.

TABLE 1

| | |
|---|---|
| Moisture in acetone % | 0.4 |
| Temperature after scraped surface crystallizer ° C. | 9 |
| PPP | 3.9 |
| POP | 68.8 |
| POO | 2 |
| Total SOS | 82.1 |
| S-N20* | 92.3 |
| S-N25 | 85.2 |
| S-N30 | 57 |
| S-N35 | 5 |
| S-N40 | 0.6 |
| DG** | 0.4 |

*S-Nx refers to stabilized N values at x ° C.
**diglycerides

Example 2

Example 1 was repeated with the modification that the mixture was cooled to 6° C. in the scraped surface crystallizer. The results are shown in Table 2.

TABLE 2

| | |
|---|---|
| Moisture in acetone % | 0.4 |
| Temperature after scraped surface crystallizer ° C. | 6 |
| PPP | 3.3 |
| POP | 67.4 |
| POO | 2.3 |
| Total SOS | 81.6 |
| S-N20 | 89.9 |
| S-N25 | 79.6 |
| S-N30 | 54 |
| S-N35 | 3.6 |
| S-N40 | 0 |
| DG | 0.9 |

Example 3

Example 2 was repeated with the modification that the solvent used was acetone containing 0.74% by weight moisture. The results are shown in Table 3.

TABLE 3

| | |
|---|---|
| Moisture in acetone % | 0.74 |
| Temperature after scraped surface crystallizer ° C. | 6 |
| PPP | 3.5 |
| POP | 66.4 |

TABLE 3-continued

| | |
|---|---|
| POO | 2.5 |
| Total SOS | 80.5 |
| S-N20 | 88.9 |
| S-N25 | 78.8 |
| S-N30 | 53.3 |
| S-N35 | 4.4 |
| S-N40 | 0 |
| DG | 1 |

Example 4

Cocoa butter equivalent (CBE) blends were made with the palm oil mid-fraction of Example 2 blended with shea stearin. Both mixtures (60/40 as well as 55/45 palm oil mid-fraction/shea stearin) gave good results.

The invention claimed is:

1. A process for producing a palm oil product, which comprises: (i) partial crystallization of a palm oil olein in the absence of a solvent; (ii) mixing the partially crystallized palm oil olein with a solvent; (iii) crystallizing the resulting mixture to a greater extent; and (iv) separating the resulting solid from the liquid in a separator, wherein the partially crystallized palm oil olein that is formed in (i) is directly mixed with solvent in (ii) without separation of solids from liquids prior to (ii).

2. A process as claimed in claim 1, wherein the partially crystallized palm oil olein that is formed in (i) comprises from 5 to 25% crystalline solids.

3. A process as claimed in claim 2, wherein the temperature of the partially crystallized palm oil olein immediately prior to mixing with the solvent in (ii) is from 10 to 25° C.

4. A process as claimed in claim 3, wherein the temperature of the solvent immediately prior to mixing with the partially crystallized palm oil olein in (ii) is from 5 to 17° C. and the temperature of the solvent is lower than the temperature of the partially crystallized palm oil olein.

5. A process as claimed in claim 4, wherein the temperature of the mixture of solvent and partially crystallized palm oil olein immediately after mixing is from 8 to 20° C.

6. A process as claimed in claim 5, wherein (ii) and (iii) are carried out in separate vessels.

7. A process as claimed in claim 6, wherein the mixing in (ii) is carried out in-line.

8. A process as claimed in claim 7, wherein (iii) is carried out in a crystallizer.

9. A process as claimed in claim 8, wherein (i) is a two-stage process carried out in two separate tanks.

10. A process as claimed in claim 9, wherein the solvent comprises acetone and water, the water being present in an amount of at least 0.3% by weight of the solvent.

11. A process as claimed in claim 10, wherein the palm oil product that is obtained as the solid after separation has the following triglyceride content:

PPP from 2.5 to 4.0% by weight;

POP greater than 65% by weight; and

POO less than 3% by weight.

12. A process as claimed in claim 11, wherein the palm oil olein is obtained by dry fractionation.

13. A process as claimed in claim 12, wherein the palm oil olein has an iodine value between 35 and 65.

14. A process as claimed in claim 13, wherein the weight ratio of solvent to palm oil olein in (ii) is in the range of from 1.5:1 to 1:1.5.

15. A process as claimed in claim 14, wherein the ratio of palm oil olein to solvent is from 0.8:1 to 1.1:1.

16. A process as claimed in claim 15, wherein the solvent is recovered and recycled.

17. A process as claimed in claim 16, which is run in parallel with the fractionation of shea oil using the same solvent.

* * * * *